US008944288B2

(12) United States Patent
Ciavarella et al.

(10) Patent No.: US 8,944,288 B2
(45) Date of Patent: Feb. 3, 2015

(54) COLLAPSIBLE CONTAINER

(75) Inventors: Nick E. Ciavarella, Seven Hills, OH (US); Aaron R. Reynolds, North Canton, OH (US); Stephanie Killion Schneider, Medina, OH (US); Anthony R. Marchetta, Broadview Heights, OH (US)

(73) Assignee: GOJO Industries, Inc., Akron, OH (US)

( * ) Notice: Subject to any disclaimer, the term of this patent is extended or adjusted under 35 U.S.C. 154(b) by 207 days.

(21) Appl. No.: 13/031,875

(22) Filed: Feb. 22, 2011

(65) Prior Publication Data

US 2012/0211520 A1 Aug. 23, 2012

(51) Int. Cl.

| | |
|---|---|
| ***B65D 35/28*** | (2006.01) |
| ***B65D 1/02*** | (2006.01) |
| ***A47K 5/122*** | (2006.01) |
| ***B65D 25/54*** | (2006.01) |
| ***B05B 11/00*** | (2006.01) |

(52) U.S. Cl.

CPC ..... *B65D 1/0292* (2013.01); *A47K 5/122* (2013.01); *B65D 25/54* (2013.01); *B05B 11/0043* (2013.01); *B05B 11/0045* (2013.01); *B05B 11/0059* (2013.01); *B05B 11/30* (2013.01); *Y10S 215/90* (2013.01)

USPC ..... 222/95; 222/107; 222/156; 222/185.1; 215/382; 215/900; 220/667; 220/675

(58) Field of Classification Search

USPC ..... 222/106–107, 92–95, 154–159, 185.1, 222/325–327; 215/381–382, 900; 220/666–667, 669, 675

See application file for complete search history.

(56) References Cited

U.S. PATENT DOCUMENTS

| | | | | | |
|---|---|---|---|---|---|
| 3,288,334 | A * | 11/1966 | Corsette | 222/107 |
| 3,727,803 | A * | 4/1973 | Cobb | 222/215 |
| 5,083,678 | A * | 1/1992 | Waring | 222/92 |
| 5,207,355 | A * | 5/1993 | Thomsen | 222/95 |
| 5,255,808 | A * | 10/1993 | Tobler | 220/6 |
| 5,445,288 | A | 8/1995 | Banks | |
| 5,556,005 | A | 9/1996 | Banks | |
| D433,938 | S | 11/2000 | Polan | |
| 6,158,620 | A * | 12/2000 | Polan | 222/92 |
| 7,357,267 | B1 * | 4/2008 | Shimada et al. | 215/381 |
| 2009/0242503 | A1 * | 10/2009 | Kuboi et al. | 215/379 |

FOREIGN PATENT DOCUMENTS

| | | | |
|---|---|---|---|
| DE | 202008008742 | U1 | 5/2009 |
| EP | 0581724 | A1 | 2/1994 |
| GB | 2260745 | A | 4/1993 |

(Continued)

*Primary Examiner* — Paul R Durand
*Assistant Examiner* — Andrew P Bainbridge
(74) *Attorney, Agent, or Firm* — Timothy D. Smith

(57) ABSTRACT

A container collapsible during dispensing of the contents therein includes a front wall, a rear wall, right and left side walls, a bottom wall, and a top wall defining a container volume holding product. A first right side wall fold line is provided in the right side wall, and a first left side wall fold line is provided in the left side wall. A rear wall fold line separates the rear wall into a first facet and a second facet. The container is sealed such that the removal of the product from the container causes the container volume to decrease, and the container folds along the first right side wall fold line, first left side wall fold line and rear wall fold line such that the first facet folds down toward the second facet.

23 Claims, 7 Drawing Sheets

(56) References Cited

FOREIGN PATENT DOCUMENTS

| | | | |
|---|---|---|---|
| GB | 2260746 | A | 4/1993 |
| JP | 53063335 | U | 5/1978 |
| JP | H06215 | U | 1/1994 |
| JP | H066215 | U | 1/1994 |

* cited by examiner

COLLAPSIBLE CONTAINER

FIELD OF THE INVENTION

The present invention generally relates to collapsible containers. In particular embodiments, the present invention relates to a collapsible container for use in a liquid dispenser. In a specific embodiment the present invention generally relates to a collapsible container useful in a wall-mounted dispenser, wherein a pump communicates with the collapsible container and the container collapses as product is removed from the container by operation of the pump.

BACKGROUND OF THE INVENTION

Collapsible containers are well know and used in a variety of environments. The collapsible container disclosed herein will be useful in any environment wherein it is desired that a container collapse as product is removed from the container. However, when disclosing aspects of the collapsible container herein, the liquid dispensing arts are focused upon. Notably, in particular embodiments, the present application focuses upon collapsible containers employed in liquid dispensers that most commonly dispense hand-treatment products such as soaps, hand sanitizers, and lotions. Nevertheless, it should again be stressed that the collapsible containers herein can be employed in a multitude of environments because the containers taught herein collapse upon the removal of product, regardless of the particular product therein or the particular environment in which they are employed.

Collapsible containers for liquid dispensers range in complexity from simple film-type plastic bags, such as those in the well-known bag-in-a-box type dispensers (e.g. U.S. Pat. No. 5,598,952), to more rigid yet collapsible structures such as that shown U.S. Pat. No. 5,083,678. The containers are sealed such that the removal of product from the container causes the container volume to decrease by the volume of the product removed. Typically, a pump is sealed to the container, and the actuation of the pump causes product to be removed from the container. In such environments, the collapsing of the container presents a number of advantages.

First, when the available product is dispensed from the container, the container is fully collapsed and thus takes up less space in any rubbish bin and landfill. Second, when the inlet to the pump is positioned within the volume of the container, the collapsing of the container can result in a more efficient evacuation of the container volume, as the collapsing of the container will force product within the container toward the pump inlet. In particular embodiments, such as in U.S. Pat. No. 5,083,678, the collapsing of the container can also serve to urge product in the container toward a sight window in a dispenser housing so that the depletion of the product within the container can be more readily monitored through that sight windows. The use of sight windows in dispenser housings, particularly wall-mounted dispensers for hand-treatment products, is well known. Finally, by providing containers that collapse in a predictable manner, it is possible to ensure that the container does not change shape in such a manner that it bulges, kinks or twists within the dispenser and undesirably contacts the internal structures of the dispenser housing. When containers bulge, kink or twist in this manner they can undesirably place stresses on the structures of the dispenser housing.

Some prior art provides for more controlled collapsing of containers through the use of fold lines formed in the container walls. Such include U.S. Pat. Nos. 5,445,288 and 5,556,005, wherein fold lines are provided so as to create container that collapses to form an I-beam structure. Though the controlled collapse is desirable, it has been found that the I-beam structure is disadvantageous, and the art will benefit from better designed collapsing structures such as those taught herein.

While the prior art does provide for different types of collapsible containers, the present invention seeks to improve the art by providing a collapsible container with specific fold lines and structures so as to collapse in a repeatable and desired manner.

SUMMARY OF THE INVENTION

This invention provides a container collapsible from a filled configuration to a substantially empty configuration during dispensing of the contents therein. The container includes a front wall, a rear wall, right and left side walls interconnecting the front wall and rear wall, a bottom wall interconnecting with the front wall, rear wall, right side wall and left side wall, and a top wall interconnecting with the front wall, rear wall, right side wall and left side wall, the walls serving to define a container volume holding product. A first right side wall fold line in the right side wall extends in a general diagonal direction downwardly and away from the rear wall from a first end proximate the intersection of the top wall and the rear wall to a second end positioned within the surface area defined by the right side wall. A first left side wall fold line in the left side wall extends in a general diagonal direction downwardly and away from the rear wall from a first end proximate the intersection of the top wall and the rear wall to a second end positioned within the surface area defined by the left side wall. A rear wall fold line extends across the rear wall, the rear wall fold line separating the rear wall into a first facet between the rear wall fold line and the top wall and a second facet between the rear wall fold line and the bottom wall, wherein the container is sealed such that the removal of the product from the container causes the container volume to decrease, and, as the container volume decreases, the container folds along the first right side wall fold line, the first left side wall fold line and the rear wall fold line such that the first facet folds down toward the second facet, and the front wall is devoid of a fold line that mimics the structure and function of the rear wall fold line such that the folding at the rear wall fold line is not simulated at the front wall, the front wall remaining more distinctly flat and non-folded as compared to the rear wall that folds about the rear wall fold line.

In other embodiments, the container as above further includes a second right side wall fold line in the right side wall extending in a general diagonal direction downwardly and away from the front wall from a first end proximate the intersection of the top wall and the front wall to a second end positioned within the right side wall. Similarly, this embodiment further includes a second left side wall fold line in the left side wall extending in a general diagonal direction downwardly and away from the front wall from a first end proximate the intersection of the top wall and the front wall to a second end positioned within the left side wall. In yet other embodiments, the second end of the first right side wall fold line and the second end of the second right side wall fold line meet at a point such that the first and second right side wall fold lines define a V-shaped facet in the right side wall, and, similarly, the second end of the first left side wall fold line and the second end of the second left side wall fold line meet at a point such that the first and second left side wall fold lines define a V-shaped facet in the left side wall, the V-shaped facet in the left side wall mirroring the V-shaped facet in the right side wall. In yet other embodiments, the rear wall fold line extends across the rear wall at a position vertically aligned with the second end of the first side wall fold line.

DETAILED DESCRIPTION OF ILLUSTRATIVE EMBODIMENTS

Figure 1:
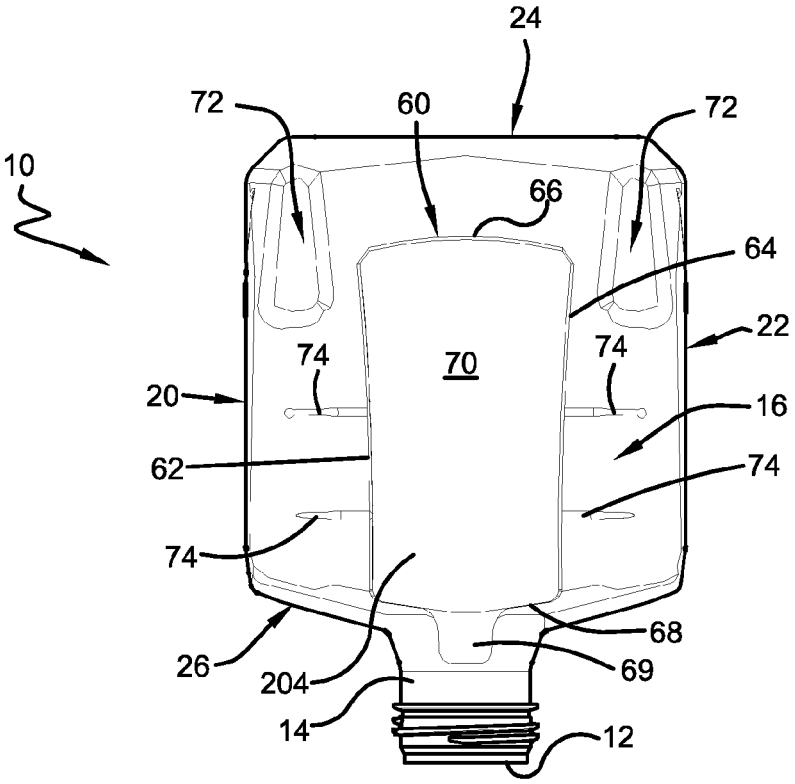
FIG. 1 is a front elevation view of the collapsible container in accordance with this invention.
Figure 4:
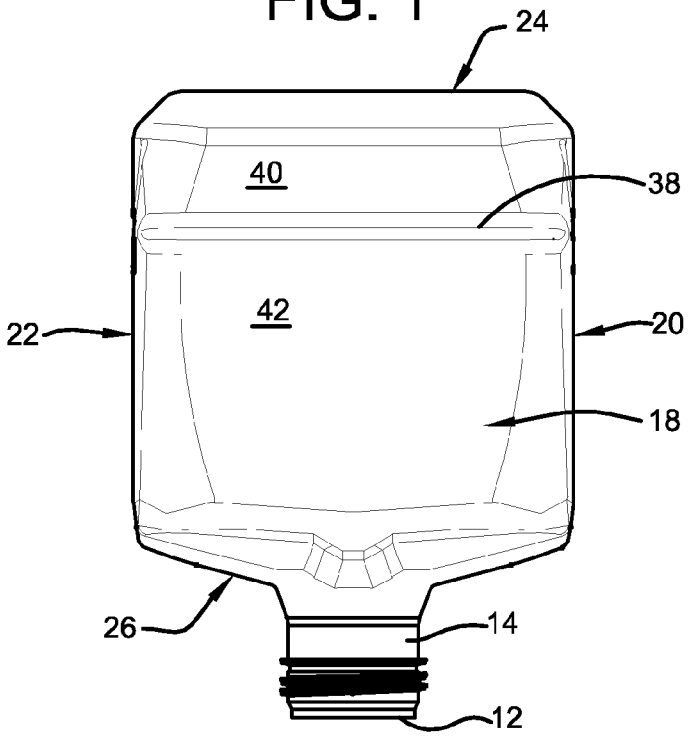
FIG. 4 is a rear elevation view of the collapsible container of FIG. 1.
Figure 3:
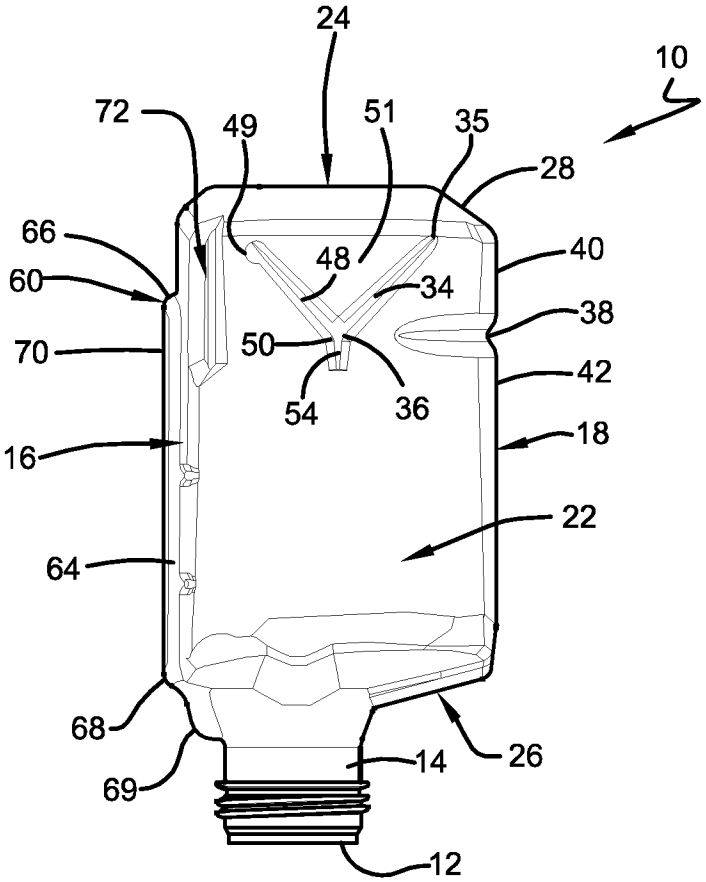
FIG. 3 is a right side elevation view of the collapsible container of FIG. 1.
Figure 2:
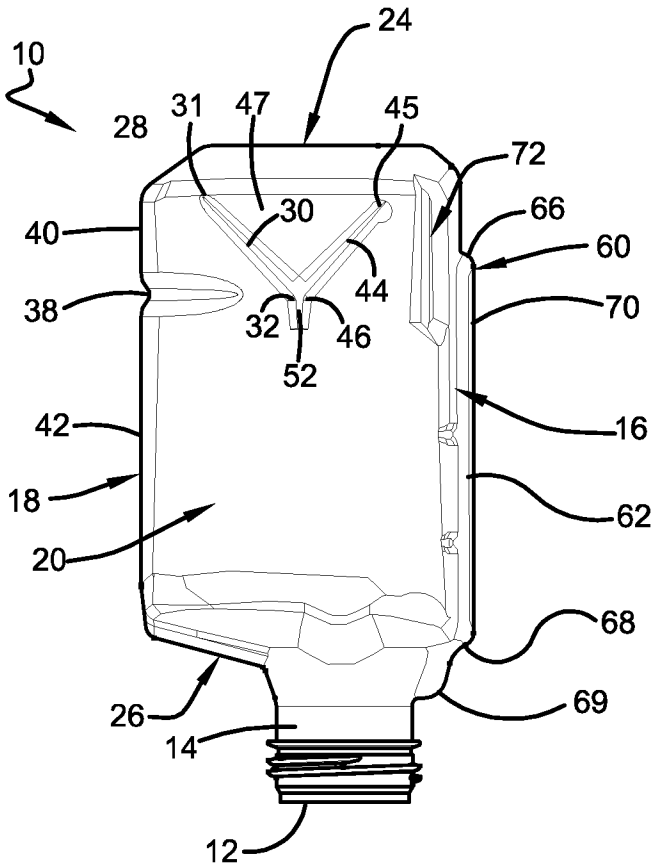
FIG. 2 is a left side elevation view of the collapsible container of FIG. 1.
Figure 6:
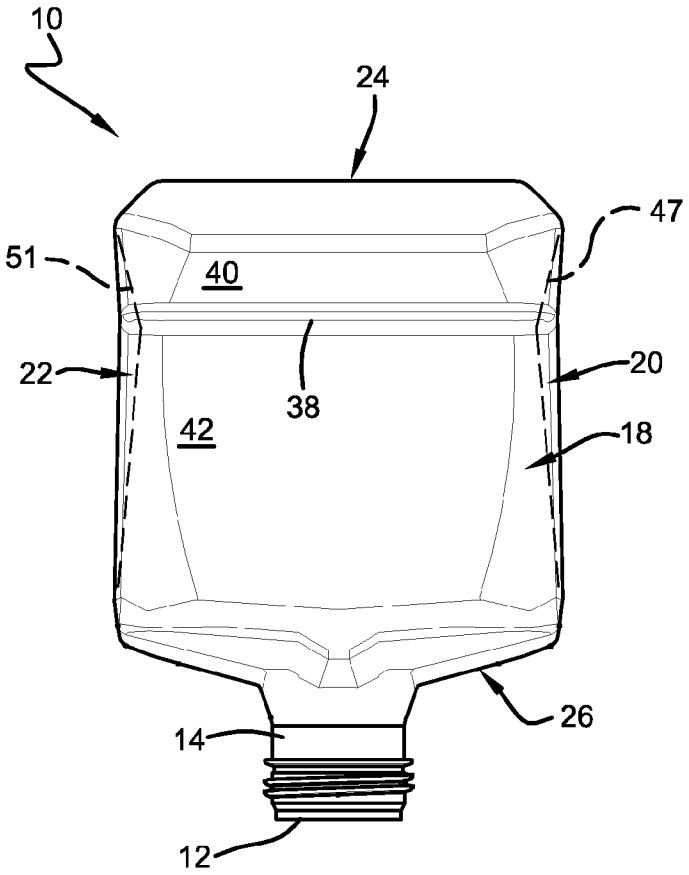
FIG. 6 is a rear elevation view of the collapsible container of FIG. 1, shown as it begins to collapse due to the removal of product.

A collapsible container in accordance with the present invention is shown in FIGS. 1-10 and designated by the numeral 10. The collapsible container is shown with an opening 12 at neck 14, but it will be appreciated that this opening 12 is typically sealed off so that, when product is removed from the container 10 the volume of the container 10 necessarily decreases such that the container 10 must collapse as it is designed to do in accordance with this invention. The container 10 is shown without the opening 12 being sealed simply because the manner in which the opening 12 is sealed so that the container 10 collapses upon the removal of product is not material to the broadest embodiment of the present invention. Nevertheless, the container 10 is shown at various stages of collapse in FIGS. 1-10. In other embodiments, the opening 12 may be sealed by a pump 100, as seen in FIGS. 11-13, but, again, in the broadest sense, this invention relates to a collapsible container without regard to how it might be sealed at an opening such as opening 12.

The container 10 includes a front wall 16, a rear wall 18, a left side wall 20, a right side wall 22, a top wall 24 and a bottom wall 26. The left and right side walls 20, 22 interconnect the front wall 16 with the rear wall 18 and the bottom wall 26 with the top wall 24. Similarly, the top wall 24 interconnects with the front wall 16, the rear wall 18, the left side wall 20 and the right side wall 22, as does the bottom wall 26. The transitions between the various walls may be slightly rounded or angled, as seen in the figures, for example at the transition 28 between the rear wall 18 and the top wall 24.

Figure 13:
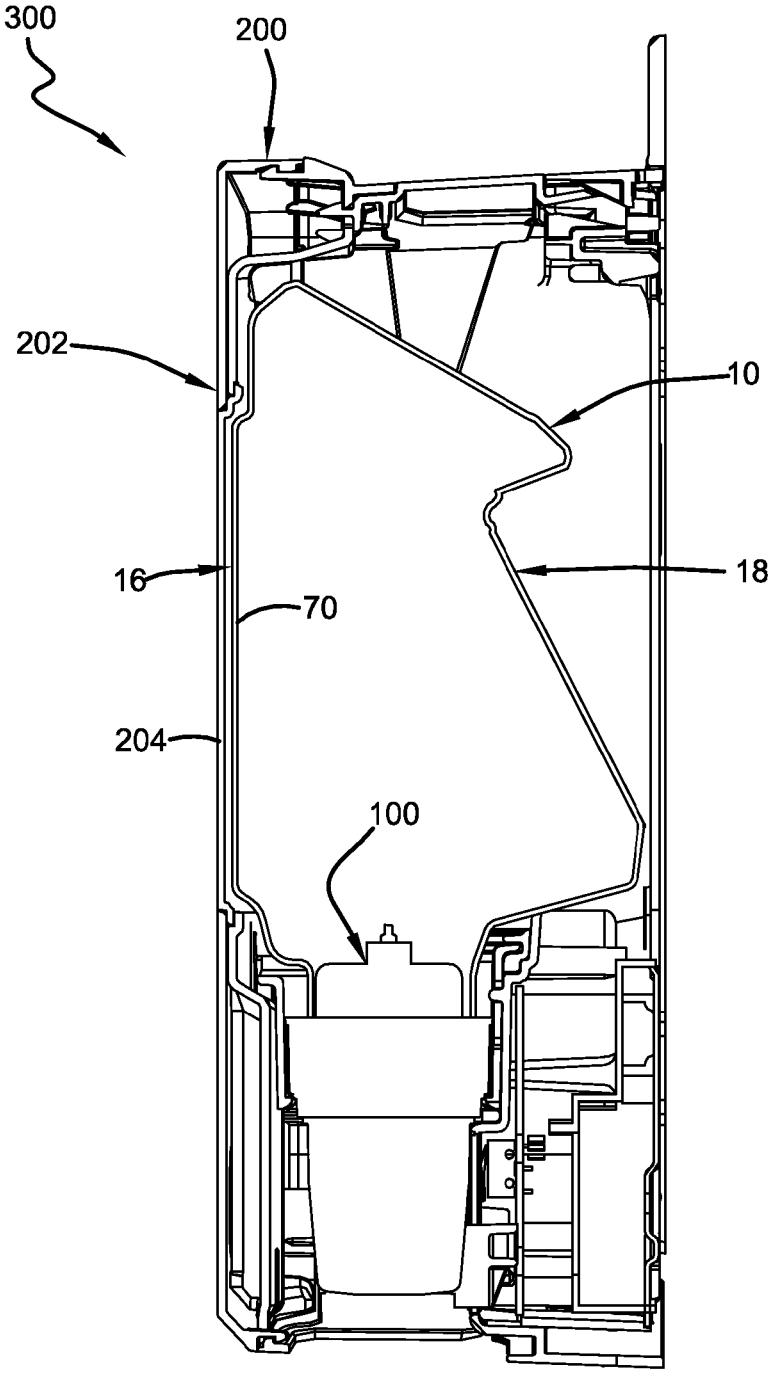
FIG. 13 is a cross-sectional view of a partially collapsed collapsible container in accordance with this invention, shown with a pump secured to the neck thereof and shown as received in a dispenser housing including a sight window.

It should be appreciated that all of the terms respecting the orientation of various walls (front, rear, left, right, top, bottom) are all relative and do not in any way limit the present invention. Indeed, in some embodiments, the container 10 may be oriented such that the bottom wall 26 is actually a top wall. However, in a particular embodiment in which the collapsible container of this invention is employed in an inverted orientation, as shown in FIG. 13, the wall with the neck 14 and opening 12 serves as a bottom wall. Thus, the term bottom wall has been employed for the wall at numeral 26, though, in other orientations, that wall may be oriented as a top wall, a front wall, a rear wall, or a side wall.

The various aforementioned walls, and, in some instances, the neck 14, define a container volume for holding product to be dispensed. When the collapsible container 10 is sealed such that there is no venting of the container and air cannot enter the container to replace removed product, the removal of product causes the container 10 to collapse. More particularly, the left side wall 20 includes a first left side wall fold line 30 that extends in a general diagonal direction downwardly (in the orientation shown) and away from the rear wall 18 from a first end 31, proximate the intersection of the top wall 24 and the rear wall 18, to a second end 32 positioned within the surface area defined by the left side wall 20. In particular embodiments, such as that shown, the second end 32 terminates at the horizontal center of the left side wall 20. Similarly, the right side wall 22 includes a first right side fold line 34 that extends in a general diagonal direction downwardly and away from the rear wall 18 from a first end 35 proximate the intersection of the top wall 24 and the rear wall 18 to a second end 36 positioned within the surface area defined by the right side wall 22. In particular embodiments, this first right side wall fold line 34 extends to a second end 36 that terminates at the horizontal center of the right side wall 22.

These and other "fold lines" disclosed herein are defined by slight detents formed in the surface of the various walls in which they are positioned. In other embodiments, they may be formed by creases pre-formed into the wall surfaces. In particular embodiments, they are detents that extend in the direction in which the fold line moves during collapse, as perhaps best seen at fold line 38 in FIGS. 2 and 3 (and disclosed more fully below). When the volume of the collapsible container 10 begins to decrease due to the removal of product, the container will tend to fold along these fold lines, and will at least fold more readily along these "fold lines" as compared to folding, twisting or buckling or otherwise collapsing along other portions of the container's surface area.

Though other materials will be found useful in accordance with this invention and will be apparent to those of ordinary skill in the art, in particular embodiments the collapsible container is formed of polyethylene terephthalate (PET), which is blow molded from a perform to inflate against a mold that provides the final shape of the container. In such a PET, blow molded embodiment, the aforementioned detents that provide the fold lines are formed in the mold so as to be imparted to the container upon forming the container.

The rear wall 18 includes a rear wall fold line 38 that extends across the rear wall 18 to separate the rear wall 18 into a first facet 40 and a second facet 42. In particular embodiments, the rear wall fold line 38 extends horizontally across the rear wall at a position vertically aligned with the second end 32 of the first left side wall fold line 30. In other embodiments, the rear wall fold line 38 is also vertically aligned with the second end 36 of the first right side wall fold line 34. Indeed, in particular embodiments, the first left side wall fold line 30 and the first right side wall fold line 34 are positioned in their respective side walls so as to be mirror images of one another, and the rear wall fold line 38 extends across the rear wall 18 at a positioned vertically aligned with both the second end 32 and the second end 36. The rear wall fold line 38 separates the rear wall 18 into a first facet 40, extending above the rear wall fold line 38 and a second facet 42 extending below the rear wall fold line 38. In particular embodiments, the first facet 40 is defined between the rear wall fold line 38 and the top wall 24, and the second facet 42 is defined between the rear wall fold line 38 and the bottom wall 26.

In a particular embodiment that is more simplified than the specific embodiment shown, the container 10 is provided with the aforementioned first left side wall fold line 30, first right side wall fold line 34 and rear wall fold line 38, and, when the container is sealed such that the removal of product causes the container volume to decrease, the container folds along the first right side wall fold line 34, the first left side wall fold line 30 and the rear wall fold line 38 such that the first facet 40 folds down toward the second facet 42, resulting a more controlled collapsing of the container. The more controlled collapsing is realized because the container tends to collapse along the aforementioned fold lines 30, 34, 38, and thus collapse in a repeatable manner, and portions of the container tend to remain more substantially flat as compared to collapsible containers of the prior art. Additionally, the front wall 16 is devoid of any fold line that would mimic the structure and function of the rear wall fold line 38, and, as a result of such structure, the folding at the rear wall fold line 38 is not simulated at the front wall 16. Instead, the front wall 16 remains more distinctly flat and non-folded as compared to the rear wall 18, which folds about the rear wall fold line 38. The top wall 24 also remains substantially flat in one or more embodiments, the top wall 24 pivoting downwardly at a pivot point proximate the joining of the top wall 24 and the front wall 16, as the first facet 40 folds down toward the second facet 42. In the present example, the first facet 40 and second facet 42 tend to remain more substantially flat during the collapsing of the container, which further tends to keep the top wall 24 substantially flat. Without the fold lines the container would instead warp and collapse in a more random manner without substantially flat facets.

In other embodiments, the collapsible container 10 further includes a second left side wall fold line 44 in the left side wall 20 that extends (in the orientation shown) in a general diagonal direction downwardly and away from the front wall 16 from a first end 45 proximate the intersection of the top wall 24 and the front wall 16 to a second end 46 positioned within the left side wall 20. In other embodiments, such as the embodiment specifically shown, this second left side wall fold line 44 extends to a horizontal center of the left side wall 20 such that it intersects with the first left side wall fold line 30 and creates a general V-shape with the first left side wall fold line 30. That is, the first left side wall fold line 30 and the second left side wall fold line 44 meet at a point and define a V-shaped facet 47 in the left side wall 20, the V-shaped facet 47 being defined between the first and second left side wall fold lines 30, 44 and the top wall 24.

Similarly, in particular embodiments, the collapsible container 10 further includes a second right side wall fold line 48 in the right side wall 22 that extends (in the orientation shown) in a general diagonal direction downwardly and away from the front wall 16 from a first end 49 proximate the intersection of the top wall 24 and the front wall 16 to a second end 50 positioned within the right side wall 22. In other embodiments, such as the embodiment specifically shown, this second right side wall fold line 48 extends to a horizontal center of the right side wall 22 such that it intersects with the first right side wall fold line 34 and creates a general V shape with the first right side wall fold line 34. That is, the first right side wall fold line 34 and the second right side wall fold line 48 meet at a point and define a V-shaped facet 51 in the right side wall 22, the V-shaped facet 51 being defined between the first and second right side wall fold lines 34, 48 and the top wall 24.

In yet other embodiments, such as that specifically shown in FIGS. 1-10, the aforementioned V shape created by the first and second left side wall fold lines 30 and 44 is instead a Y shape due to the inclusion of a left side wall vertical fold line 52 that creates a three-way intersection with the second ends 32 and 46 of the first and second left side wall fold lines 30 and 44. Similarly, the aforementioned V shape created by the first and second right side wall fold lines 34 and 48 is instead a Y shape due to the inclusion of a right side wall vertical fold line 54 that creates a three-way intersection with the second ends 36 and 50 of the first and second right side wall fold lines 34 and 48. Notably, this fold line can extend for a very limited vertical length, so as to be just sufficient to encourage vertical folding as discussed below, and can also extend for a significant vertical length, even to the point of extending the entire height of the side walls, from the intersection with the first and second side wall fold lines to the bottom of the side walls.

As can be seen in FIGS. 5-8, as the volume of container 10 decreases, the container 10 folds along the first and second left side wall fold lines 30, 44 and along the first and second right side wall fold lines 34, 48 such that the V-shaped facets 47, 51 fold inwardly. Additionally, the left side wall 20 collapses inwardly about a line extending generally vertically from the point where the first left side wall fold line 30 and the second left side wall fold line 44 meet, and, similarly, the right side wall 22 collapses inwardly about a line extending generally vertically from the point where the first right side wall fold line 34 and the second right side wall fold line 48 meet. By extending generally vertically it is meant that the line extends in an upwardly and downwardly direction given the orientation shown, though it may also extend slightly in a horizontal direction as well, i.e., somewhat diagonally. That is, the line along which the left side wall 20 and right side wall 22 collapse inwardly need not be perfectly vertical, i.e., perfectly straight up-and-down, in the orientation provided in the figures. Indeed, because of the resistance imparted to the collapsing of the walls by the structure of the bottom wall 26, the aforementioned generally vertically extending line about which the right and left side walls collapse tends to extend vertically and rearwardly toward the rear wall 18 of the container 10. This is particularly true in light of reinforcement provided to the front wall 16 in specific embodiments. Such reinforcements will be discussed more fully below. When the aforementioned left and right side wall vertical fold lines 52 and 54 (forming Y-shaped fold line intersections) are employed, this collapsing inwardly about a generally vertical line is facilitated.

With continued reference to FIGS. 5-10 it can be seen that the first facet 40 of the rear wall 18 folds downwardly toward the second facet 42, while the top wall 24 folds proximate the intersection (or transition) to the front wall 16. Furthermore, the V-shaped facets 47, 51 fold inwardly. As seen, this folding pattern permits the front wall 16 to remain substantially vertical through a significant changing of the volume of the container 10. This may be advantageous in certain environments as will be described more fully below. It can additionally be appreciated that the container 10 collapses in a manner such that the bottom portion thereof tends to collapse in a form that slightly mimics the upper portion. That is, though the various fold lines presented near the top wall 24 are not repeated near the bottom wall 26, the left and right side walls still tend to collapse inwardly with generally V-shaped facets, as shown at 56 (left side wall 20) and 58 (right side wall 22).

Figure 5:
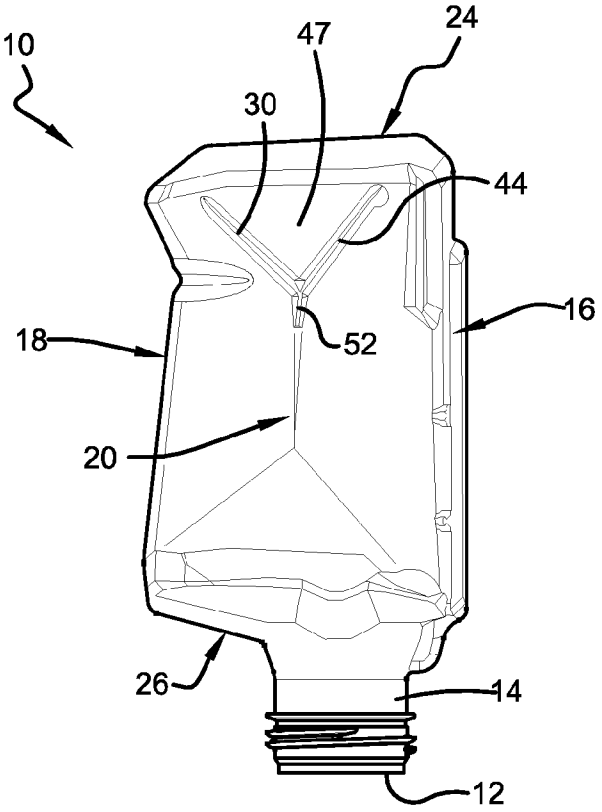
FIG. 5 is a left side elevation view of the collapsible container of FIG. 1, shown as it begins to collapse due to the removal of product.
Figure 8:
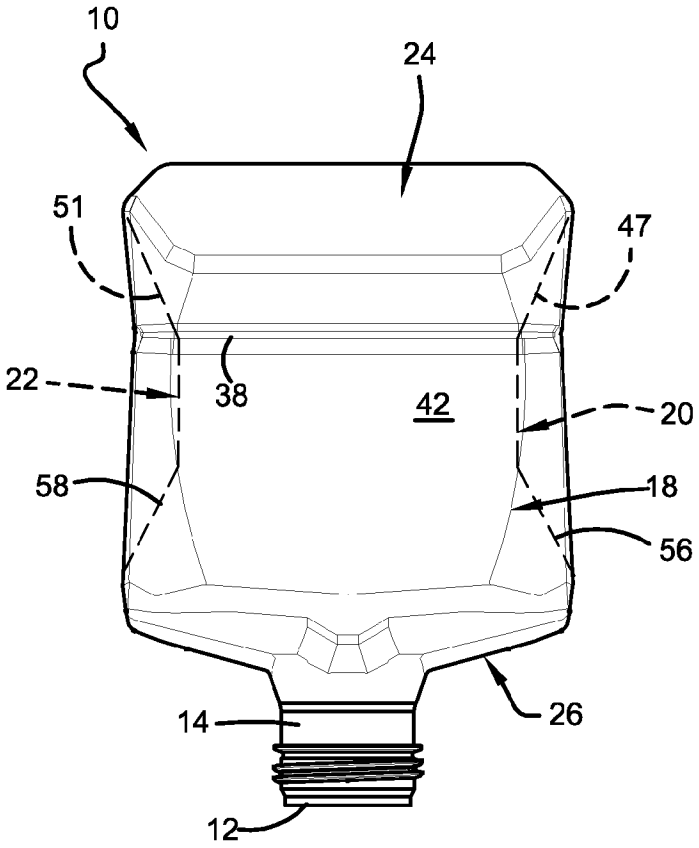
FIG. 8 is a rear elevation view of the collapsible container of FIG. 1, shown upon further collapse due to the removal of yet more product as compared to FIG. 5.
Figure 7:
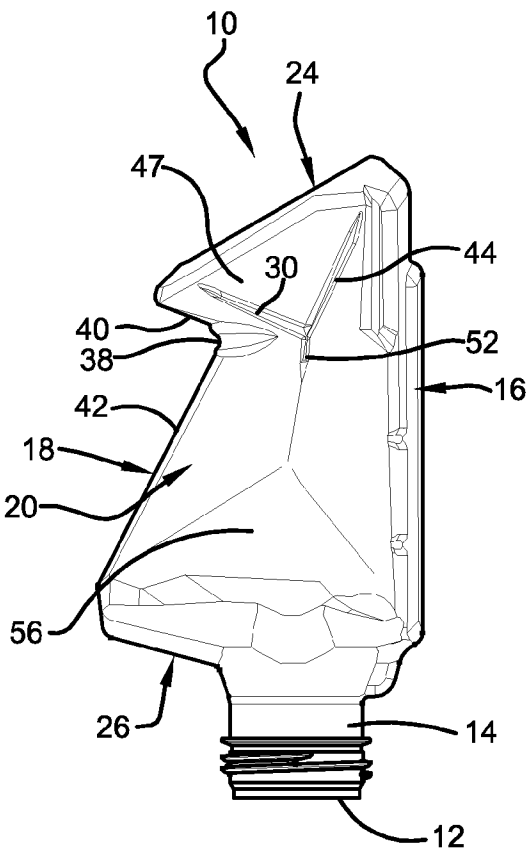
FIG. 7 is a left side elevation view of the collapsible container of FIG. 1, shown upon further collapse due to the removal of yet more product as compared to FIG. 5.
Figure 10:
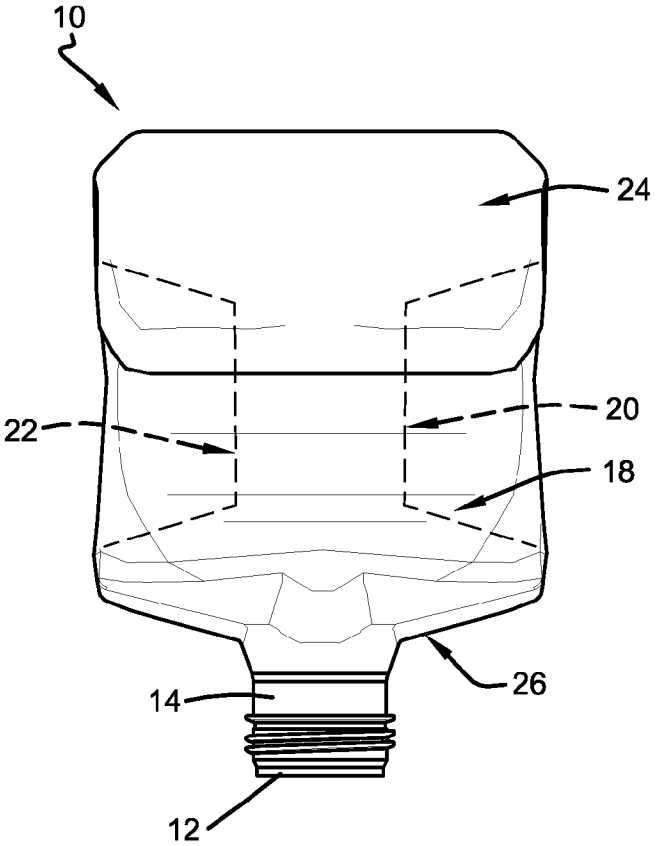
FIG. 10 is a rear elevation view of the collapsible container of FIG. 1, shown fully collapsed.
Figure 9:
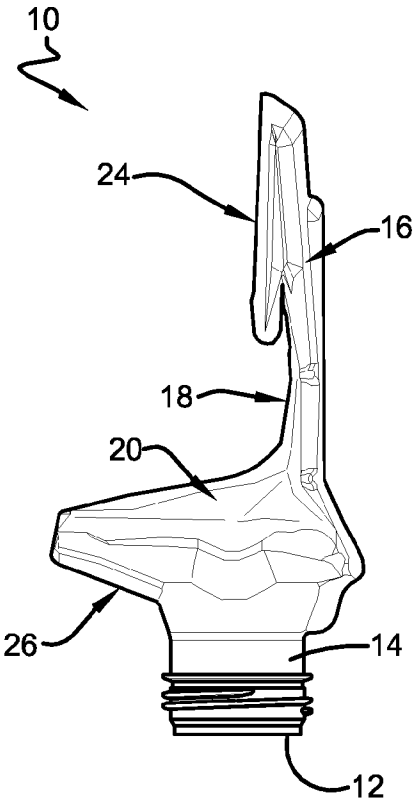
FIG. 9 is a left side elevation view of the collapsible container of FIG. 1, shown fully collapsed.

In particular embodiments as disclosed above, the front wall 24 does not include a fold line that would mimic the folding experienced at the rear wall 18. In other embodiments, the front wall 24 is completely devoid of fold lines. Referring back to FIGS. 1-3, it can be seen that, in yet other embodiments, the front wall 16 is devoid of fold lines and reinforced with a number of surface geometries serving to stiffen the front wall 16 and thereby cause the front face to resist collapsing, particularly as compared to the rear wall 18, the left side wall 20 and the right side wall 22. In this particular embodiment, the front wall 16 includes a shaped protrusion 60 defined by a left side wall 62, a right side wall 64, a top wall 66 and a bottom wall 68, all protruding outwardly from the front wall 16 to define a window face 70 of the shaped protrusion 60. The walls 62 and 64 defining the window face 70 extend outwardly from the remainder of the front wall 16, with the result that the window face 70, and, more generally, the front wall 16 resists buckling and collapsing inwardly toward the rear wall 18. The width of the walls 62 and 64 discourages the front wall 16 from folding about a horizontal line (in the orientation of FIG. 1), thus encouraging the folding of the rear wall 18 both at the fold line 38 and proximate the bottom wall 26 (as seen in FIGS. 5, 7, and 9).

In the particular embodiment shown, a lug 69 is formed extending from the bottom wall 68, the bottom wall 26 and the neck 14. This lug 69 strengthens the container 10 at the transition between the front wall 16 and the bottom wall 26 and the neck 14 such that it strengthens the front wall 14 against buckling and folding at the area proximate the bottom wall 26 and the transition to the neck 14.

In particular embodiments, such as that shown, the walls 62-68 extend generally orthogonal to the front wall 16, and the window face extends generally parallel to (and forms part of) the front wall 16. The window face 70 is provided for a purpose that will be described in more detail below, and it should be appreciated that embodiments of this invention need not have a window face 70. Without a window face 70, the front wall 16 could instead include geometries such as ribs or other protrusions to cause the front wall 16 to resist collapsing toward the rear wall 18. In other embodiments, it may be desirable to permit the collapsing of the front wall 16, and, thus no such geometries need be employed. In the particular embodiment shown, however, the front wall 16 is intended to resist collapsing, and, in addition to the walls 62-68, other vertical geometries 72 and horizontal geometries 74 are employed to reinforce the front wall 16. The various geometries reinforce the front wall 16 so that it resists buckling and collapsing to a greater extent than the side walls and rear wall containing no reinforcing geometries and instead containing purposefully placed fold lines. Some advantages of this structure are specifically noted below.

Figure 12:
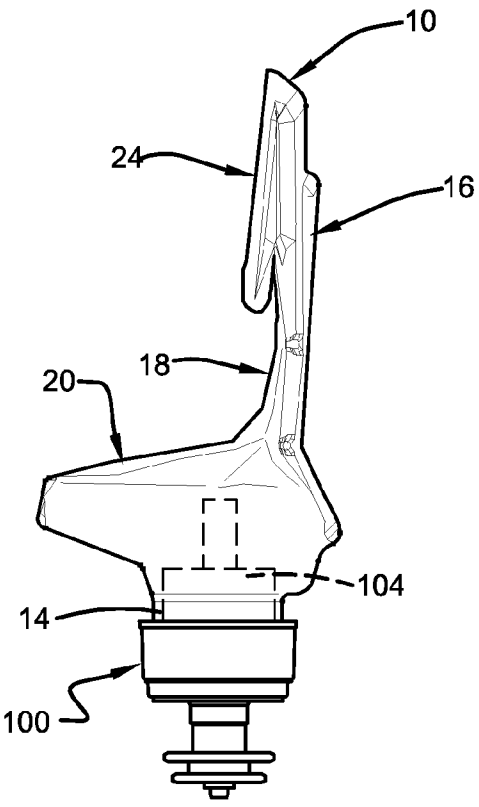
FIG. 12 is a left side elevation view of the pump and collapsible container combination of FIG. 11, shown fully collapsed.
Figure 11:
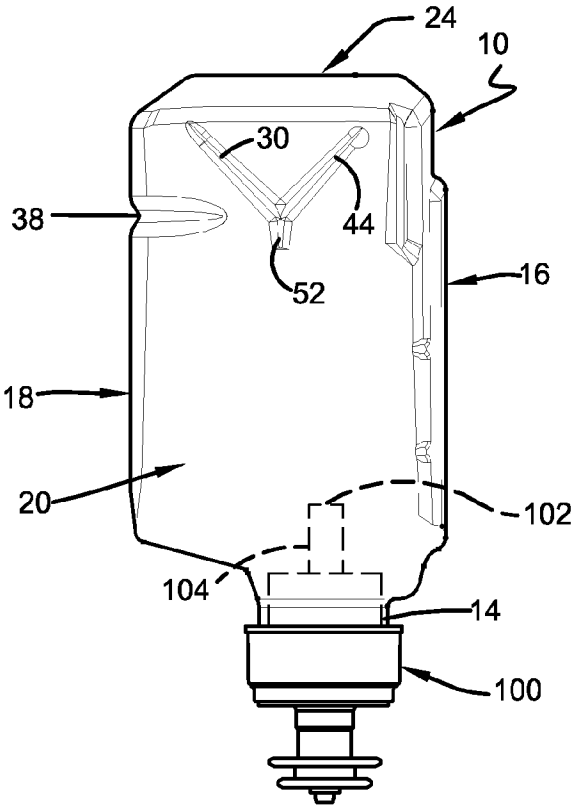
FIG. 11 is a left side elevation view of the collapsible container of FIG. 2, shown with a pump secured to its neck.

As seen in FIGS. 11 and 12, when a pump 100 is secured to the opening 12 to provide an inlet 102 inside and above the bottom wall 26, the controlled collapsing of the container 10 serves to cause the product to be efficiently removed from the container. Particularly, as the container collapses, the front, rear and side walls tend to collapse inwardly toward the extension 104 of the pump 100, and this forces the remaining product toward the inlet 102 so that nearly all of the product can be removed from the container 10 upon continued actuation of the pump 100. More particularly the portions of the walls that define the container volume below the inlet 102 are collapsed such that the contents of that volume are urged toward the inlet 102. In particular embodiments, the neck 14 and opening 12 are offset from the horizontal center of the container 10, being instead positioned closer to the front wall 16. This positioning can help ensure that pumps such as pumps 100, which provide an extension such as extension 104 extending into the container 10, are not contacted by the folding and collapsing walls of the container. This positioning also serves to reinforce the front wall against buckling and collapsing, aiding it in remaining more substantially flat as the container collapses.

A container and pump combination has been disclosed with respect to FIGS. 11 and 12. The combination of a container and pump is well know in the art of dispensing hand treatment products, and, in FIG. 13, a combination container 10 and pump 100 is shown mounted in a wall-mounted dispenser housing 200 to form a dispenser 300. The combination container 10 and pump 100 is shown partially collapsed. Notably, the front wall 16 lies in close proximity to the front wall 202 of the dispenser housing 200, when the combination container 10 and pump 100 is properly received in the dispenser housing 200. Due to the structure of the collapsible container 10, whether in more simplified embodiments disclosed herein or in the more specific embodiments as specifically shown in the Figures and described in detail, the front wall 16 notably remains significantly flat during the evacuation of the contents of the collapsible container 10, as compared to the remaining vertical walls, the left side wall 20, the right side wall 22 and the rear wall 18. Thus, the front wall 16 stays in relatively close proximity to the front wall 202 of the dispenser housing 200 for a significant duration of the collapsing of the container 10. As mentioned above, this is particularly true when the aforementioned reinforcing geometries are employed.

This reinforcement of the front wall 16 is particularly advantageous when the collapsible container is transparent at the front wall 16 and the front wall 202 of the dispenser housing 200 is provided with a sight window 204. Keeping the front wall 16 of the container 10 close to the sight window 204 helps ensure that users of or service personnel for the dispenser 300 can readily view the level of the product in the container 10. Additionally, as the container 10 collapses, with the front wall 16 remaining significantly flat and in close proximity to the sight window 204, the container appears to the user viewing the contents through the sight window 204 to be fuller than would be appreciated if the side view could be seen by the user. Because the front wall 16 does not significantly collapse or buckle until the container 10 is closer to being empty, the collapsing of the side and rear walls forces product to appear at a high level on the front wall 16. This is advantageous because studies have shown that end users consider a dispenser with a fuller container and/or a container that does not appear to be buckled or collapsed to be more hygienic and desirable to use. In the specific embodiment shown, the front wall 16 includes a window face 70 that is generally aligned with and shaped similarly to the site window 204. The walls 62-68 defining the window face 70 prevent the front wall 16 and window face 70 from buckling and collapsing, and thus provide the benefits mentioned above.

In light of the foregoing, it should be appreciated that the present invention significantly advances the art by providing a collapsible container that is structurally and functionally improved in a number of ways. While particular embodiments of the invention have been disclosed in detail herein, it should be appreciated that the invention is not limited thereto or thereby inasmuch as variations on the invention herein will be readily appreciated by those of ordinary skill in the art. The scope of the invention shall be appreciated from the claims that follow.

What is claimed is:

1. A container collapsible from a filled configuration to a substantially empty configuration during dispensing of the contents therein, the container comprising:

a front wall;

a rear wall;

right and left side walls interconnecting said front wall and rear wall;

a bottom wall interconnecting with said front wall, rear wall, right side wall and left side wall;

a top wall interconnecting with said front wall, rear wall, right side wall and left side wall, said front wall, rear wall, right side wall, left side wall, top wall and bottom wall defining a container volume holding product;

a neck extending from said bottom wall and providing an opening communicating with said container volume, said neck and opening being offset from a horizontal center of the container so as to be positioned closer to said front wall;

a pump sealed within said opening in said neck, said pump including an extension extending into said container volume said product being dispensed from said container volume through actuation of said pump;

a rear wall fold line extending across said rear wall, said rear wall fold line separating said rear wall into a first facet extending from said rear wall fold line to said top wall and a second facet extending from said rear wall fold line to said bottom wall, wherein the container is sealed such that the removal of said product from said container through actuation of said pump causes said container volume to decrease, and, as said container volume decreases, said container folds along said rear wall fold line such that said first facet folds down toward said second facet, and said front wall is devoid of a fold line that mimics the structure and function of said rear wall fold line such that the folding at said rear wall fold line is not simulated at said front wall, said front wall remaining more distinctly flat as compared to said rear wall that folds about said rear wall fold line, wherein said front wall includes a reinforcing geometry that reinforces the structure of said front wall such that it resists collapsing during dispensing of the contents therein to a greater extent than said rear wall, said left side wall and said right side wall, such that said extension of said pump is not contacted by the folding and collapsing walls of the container; and a lug protruding outwardly from a transition point between the front wall and the bottom wall to resist collapsing of the front wall in the direction of the bottom wall when product is removed from the container through actuation of the pump.

2. The container of claim 1, further comprising:

a first right side wall fold line in said right side wall extending in a general diagonal direction downwardly and away from said rear wall from a first end proximate the intersection of said top wall and said rear wall to a second end positioned within the surface area defined by said right side wall; and a first left side wall fold line in said left side wall extending in a general diagonal direction downwardly and away from said rear wall from a first end proximate the intersection of said top wall and said rear wall to a second end positioned within the surface area defined by said left side wall, wherein as said container volume decreases, said container folds along said first right side wall fold line and said first left side wall fold line in addition to said rear wall fold line.

3. The container of claim 2, wherein said rear wall fold line extends across said rear wall at a position vertically aligned with said second end of said first side wall fold line.

4. The container of claim 3, wherein said first left side wall fold line extends in a general diagonal direction that mirrors the extension of said first right side wall fold line.

5. The container of claim 4, wherein said second end of said first left side wall fold line lies proximate the horizontal center of said left side wall and said second end of said right side wall fold line lies proximate the horizontal center of said right side wall.

6. The container of claim 2, further comprising a second right side wall fold line in said right side wall extending in a general diagonal direction downwardly and away from said front wall from a first end proximate the intersection of said top wall and said front wall to a second end positioned within said right side wall;

a second left side wall fold line in said left side wall extending in a general diagonal direction downwardly and away from said front wall from a first end proximate the intersection of said top wall and said front wall to a second end positioned within said left side wall.

7. The container of claim 6, wherein said second left side wall fold line extends in a general diagonal direction that mirrors the extension of said second right side wall fold line.

8. The container of claim 7, wherein said second end of said first right side wall fold line and said second end of said second right side wall fold line meet at a point such that said first and second right side wall fold lines define a V-shaped facet in said right side wall.

9. The container of claim 8, wherein said second end of said first left side wall fold line and said second end of said second left side wall fold line meet at a point such that said first and second left side wall fold lines define a V-shaped facet in said left side wall, the V-shaped facet in said left side wall mirroring the V-shaped facet in said right side wall.

10. The container of claim 9, wherein, as said container volume decreases, the container folds along said first and second right side wall fold lines and along said first and second left side wall fold lines, such that said V-shaped facet in said right side wall and said V-shaped facet in said left side wall fold inwardly.

11. The container of claim 10, wherein said right side wall collapses inwardly about a line extending vertically from the point where said first right side wall fold line and said second right side wall fold line meet, and said left side wall collapses inwardly about a line extending vertically from the point where said first left side wall fold line and said second left side wall fold line meet.

12. The container of claim 11, further comprising a left side wall vertical fold line that creates a three-way intersection with the second ends of said first and second left side wall fold lines, and a right side wall vertical fold line that creates a three-way intersection with the second ends of said first and second right side wall fold lines, the said left and right side wall vertical fold lines serving to facilitate the inwardly collapsing of said left and right side walls.

13. The container of claim 1, wherein said top wall remains substantially flat as said container volume decreases.

14. The container of claim 1, wherein said right side wall and said left side wall collapse inwardly as said container volume decreases.

15. The container of claim 1, wherein said front wall includes a sight window.

16. The container of claim 1, wherein said reinforcing geometry is provided by a shaped protrusion defining a window face.

17. The container of claim 1, wherein said front wall is devoid of fold lines.

18. The container of claim 1, wherein fold lines are not provided near said bottom wall.

19. A collapsible container, comprising:

A plurality of walls including a front wall, a rear wall, a top wall, a bottom wall, a first side wall and a second side, said plurality of walls being contiguously formed to define a container volume for holding an associated fluid product;

a neck extending from said bottom wall, said neck being supported by said bottom wall, said neck including an egress opening through which said associated fluid product is drained from said container;

wherein said rear wall includes an indented fold line extending across said rear wall to selectively permit said rear wall to fold into first and second facets, wherein said first facet extends from said fold line to said top wall, wherein said second facet extends from said fold line to said bottom wall, and wherein said fold line is positioned at an elevation closer to the top wall than the bottom wall;

wherein said front wall includes a shaped protrusion defining a transparent window face, said window face being positioned on said front wall to reinforce said front wall against folding; and a lug protruding outwardly from a transition point between the front wall and the bottom wall to resist collapsing of the front wall in the direction of the bottom wall.

20. The collapsible container as defined in claim 19, wherein said window face extends substantially along the entire height of the front wall.

21. The collapsible container as defined in claim 19, wherein said lug extends from said window face.

22. The collapsible container as defined in claim 21, wherein said lug comprises a single lug symmetrically fashioned about a centerline of the window face.

23. The collapsible container as defined in claim 19, wherein when said container volume decreases, said container folds along said rear wall fold line such that said first facet folds down toward said second facet, and said front wall is devoid of a fold line that mimics the structure and function of said rear wall fold line such that the folding at said rear wall fold line is not simulated at said front wall.

* * * * *